US012370403B2

(12) United States Patent
Liu et al.

(10) Patent No.: US 12,370,403 B2
(45) Date of Patent: Jul. 29, 2025

(54) MINI FOLDABLE TREADMILL

(71) Applicant: Shenzhen Yile Dynamic Technology Co., LTD, Guangdong (CN)

(72) Inventors: Ren Liu, Guangdong (CN); Jinsong Fan, Guangdong (CN)

(73) Assignee: Shenzhen Yile Dynamic Technology Co., LTD, Shenzhen (CN)

( * ) Notice: Subject to any disclaimer, the term of this patent is extended or adjusted under 35 U.S.C. 154(b) by 80 days.

(21) Appl. No.: 18/347,156

(22) Filed: Jul. 5, 2023

(65) Prior Publication Data

US 2024/0399197 A1 Dec. 5, 2024

(30) Foreign Application Priority Data

Jun. 5, 2023 (CN) ..... 202321421048.0

(51) Int. Cl.
*A63B 22/02* (2006.01)

(52) U.S. Cl.
CPC ..... *A63B 22/02* (2013.01); *A63B 22/0235* (2013.01); *A63B 2210/50* (2013.01)

(58) Field of Classification Search
None
See application file for complete search history.

(56) References Cited

U.S. PATENT DOCUMENTS 4,522,436 A * 6/1985 Hoen ..... E05C 19/14 292/DIG. 60
7,357,758 B2 * 4/2008 Polk, III ..... A63B 22/0235 482/54
8,926,479 B2 * 1/2015 Chen ..... A63B 22/02 292/137
9,168,414 B2 10/2015 Liu et al.
2004/0116255 A1 * 6/2004 Chen ..... A63B 22/02 482/54
2011/0068588 A1 * 3/2011 Kopylov ..... E05C 19/14 292/200
2015/0051051 A1 2/2015 Liu et al.
2016/0096064 A1 * 4/2016 Gatti ..... A63B 69/0057 482/54
2022/0379165 A1 * 12/2022 Alfandre ..... A63B 21/00047
2023/0136863 A1 * 5/2023 Luo ..... A63B 21/023 482/54

FOREIGN PATENT DOCUMENTS

CN 200991528 Y * 12/2007
CN 107261393 A * 10/2017
(Continued)

*Primary Examiner* — Shila Jalalzadeh Abyaneh

(57) ABSTRACT

The present application relates to a mini foldable treadmill, a lower end of the strut is rotatably connected to one end of a running plate; a part of the swivel arm near the middle of the swivel arm is hinged to the strut by an second rotation axis, a connector is disposed at the lower end of the swivel arm, which is connected to the upper end of the transmission portion, the lower end of the transmission portion is connected to the upper end of the spring pin, the spring pin is slidably mounted at the lower end of the strut, a fastener is disposed on the running plate, a pin hole is disposed thereon, and the spring pin is driven to extend so that the strut is in an upright state or driven to retract so that the strut is not in an upright state.

9 Claims, 8 Drawing Sheets

(56) References Cited

FOREIGN PATENT DOCUMENTS

| | | | | | |
|---|---|---|---|---|---|
| CN | 106390370 | B | * | 9/2018 | ..... A63B 22/02 |
| CN | 207871380 | U | * | 9/2018 | ..... A61H 7/002 |
| CN | 109395316 | A | * | 3/2019 | ..... A63B 22/02 |
| CN | 109603083 | A | * | 4/2019 | |
| CN | 208943361 | U | | 6/2019 | |
| CN | 210813709 | U | * | 6/2020 | |
| CN | 211273365 | U | * | 8/2020 | |
| CN | 112741994 | A | * | 5/2021 | ..... A63B 22/02 |
| CN | 112774093 | A | * | 5/2021 | ..... A63B 22/02 |
| CN | 215995473 | U | * | 3/2022 | |
| CN | 114904215 | A | * | 8/2022 | ..... A63B 22/0214 |
| CN | 217489652 | U | * | 9/2022 | |

* cited by examiner

MINI FOLDABLE TREADMILL

TECHNICAL FIELD

This application relates to exercise equipment, and specifically relates to a mini foldable treadmill.

BACKGROUND

A treadmill is a common exercise equipment. The treadmill generally consists of a running plate, a strut, and a handrail. The rotating running belt and the motor and other devices are disposed on the running plate, the lower end of the strut is connected to the front end of the main frame, the handrail is disposed on the upper end of the strut, and the handrail is generally configured as the right and left two.

The foldable treadmill is generally provided with a rotation structure between the strut and the running plate and a rotation structure between the strut and the handrail. For example, in the Chinese utility model patent with the patent number "202123041090.3", the foldable treadmill is provided with a foldable mechanism of the handrail between the handrail and the strut and a foldable mechanism of the strut between the strut and the running platform, and the foldable mechanism of the handrail and the foldable mechanism of the strut are linked. However, the two foldable mechanisms of this folding treadmill have too many parts, including a variety of rotating parts and a variety of locking parts, and the structure is complicated and the size is large, so it is difficult to design a mini and foldable treadmill.

SUMMARY

This application provides a mini foldable treadmill, to resolve a problem in a related technology a structure of the mini foldable treadmill is relatively complicated and the size of the mini foldable treadmill is relatively large. Technical solutions are as follows.

A mini foldable treadmill is provided, comprising a running plate, at least one strut and a frame, said handrail and said console are configured on said frame, the lower end of said strut is rotatably connected to one end of said running plate; a lower end of said strut is hinged to one end of said running plate by means of a first rotation axis, a swivel arm of the same number as said strut is mounted on said frame, the part of said swivel arm near the middle of said swivel arm is hinged to said strut by means of a second rotation axis, at least one of said swivel arms is provided with a connector at its lower end, said connector is connected to an upper end of a transmission component, a lower end of said transmission component is connected to an upper end of a spring pin, said spring pin is slidably connected to said lower end of said strut, a fastener of said spring pin is provided on said running plate, said fastener is provided with a pin hole to fit said spring pin, said spring pin is optionally driven to extend to keep said strut in an upright state or driven to retract in order to keep said strut out of said upright state.

In some embodiments, said fastener is a fastening piece, said fastening piece is connected to one end of said running plate and a hole is disposed in said fastening piece so that the lower end of said spring pin is concentrically aligned with said hole when said strut is maintained in said upright state.

In some embodiments, said fastener is a fastening piece, said fastening piece is connected to one end of said running plate and a hole is disposed in said fastening piece so that the lower end of said spring pin is concentrically aligned with said hole when said strut is maintained in said upright state.

A mini foldable treadmill is provided, comprising A mini foldable treadmill comprising a running plate, at least one strut and a frame, the handrail and the console being arranged on the frame, the lower end of the strut being rotatably connected to one end of the running plate, a lower end of the strut is hinged to one end of the running plate by means of a first rotation axis, a swivel arm of the same number as the strut is mounted on the frame, the part of the swivel arm near the middle of the swivel arm is hinged to the strut by means of a second rotation axis, at least one of the swivel arms is provided with a connector at its lower end, the connector is connected to an upper end of a transmission component, a lower end of the transmission component is connected to an upper end of a spring pin, the spring pin is slidably connected to the lower end of the strut, a fastener of the spring pin is provided on the running plate, the fastener is provided with a pin hole to fit the spring pin, the spring pin is selectively actuated to extend so that the strut is in an upright state or selectively actuated to retract so that the strut is not in an upright state.

In some embodiments, the fastener is a fastening piece, the fastening piece is connected to one end of the running plate and a hole is disposed in the fastening piece so that the lower end of the spring pin is concentrically aligned with the hole when the strut is maintained in the upright state.

In some embodiments, a spacing part is configured in the fastening piece, the spacing part and the lower end of the strut are spaced apart to avoid the collision between the strut and the fastening piece when the strut is rotated, via this solution, the fastening piece can be disposed as close as possible to the lower end of the strut, and the rotation of the strut is not interrupted by the fastening piece, and the lower end of the spring pin is inserted more firmly into the hole of the fastening piece of the spring pin.

In some embodiments, the treadmill further comprising a protective case and a spring, the protective case is configured at the lower end of the strut, the spring pin is slidably inserted in the protective case, the spring is disposed around the periphery of the spring pin, one end of the spring is connected to the spring pin, the other end of the spring is connected to the protective case, the spring pin is moved towards the lower end of the strut by the thrust of the spring, via this solution, the spring pin is automatically inserted in the hole of the spring pin's fastening piece, and the strut is automatically inserted and locked to the running plate for enhanced practicability.

In some embodiments, the transmission component is a wire rope, via this solution, the wire rope and the protection case cooperate to make a reliable linkage between the swivel arm and the spring, and the treadmill is easy to dispose and low cost to use.

In some embodiments, the strut is configured as a square tube, the strut is provided with openings at its upper end and at its lower end, the swivel arm, via this solution, the transmission component and the spring pin are located inside the square tube, the components can be contained inside the struts, which make the appearance of the treadmill more attractive and simpler.

In some embodiments, the treadmill further comprising at least one lock mechanism, the lock mechanism comprising a lock, a handle and a hook piece, the upper end of the handle is hinged to the side wall of the strut by a rotation axis, the lower end of the lock is rotatably connected to a portion of the handle near the middle of the handle, the upper end of the lock is hung on a hook at the lower end of the hook piece, upper end of the hook piece is disposed on the lower side wall of the handrail, via this solution, when the two handrails and the two struts are locked, the lower end of the handle is pulled upward, the lock is raised, the upper end of the lock is hooked on the hook of the lower end of the hook piece, the lower end of the handle is pulled downward, the lock is pulled downward, the hook piece is tightened downward by the lock, the upper end of the two handrails and the upper end of the struts are locked, this solution is simple to operate, low cost to use and the size is small; when the treadmill is in the unfolded state, the two handrails are locked to the upper end of the strut by the lock mechanism, the handrails and the strut are locked, the lower end of the spring pin is inserted into the hole of the fastening piece of the spring pin, the strut and the running plate are locked to the upright state, when the treadmill is in the folded state, the lock mechanism is opened, the two handrails are rotated and folded to the strut, the swivel arm is driven by the end of the handrail to rotate around the second rotation axis synchronously, the transmission component is pulled upward by the connector, and the spring pin is pulled upward by the transmission component. The lower end of the spring pin is disconnected from the hole of the fastening piece of the spring pin, so that the two handrails can be folded to the strut which is folded to the running plate. Compared with the prior art, the foldable mechanism of the solution has fewer parts, and its structure is simpler and the size is smaller, so a mini and foldable treadmill can be designed. When the treadmill is folded and unfolded, the user only needs to make the two handrails be unlocked with the two struts using both hands, and all the operations can be completed by operating the two handrails only, without the user bending down to make the struts and running board be unlocked, the treadmill is simple and convenient to operate, and its practicality is good.

In some embodiments, the first rotation axis and the second rotation axis are both configured as lead screw nuts, which is reliable and low cost.

In some embodiments, the treadmill further comprising two rollers, the two rollers are rotatably connected to the bottom of the running plate, via this solution, the treadmill is folded and can be easily moved for good practicality.

In some embodiments, the treadmill further comprising at least four pads, the pads are disposed at the corners of the bottom of the running plate, via this solution, after the treadmill is unfolded it is installed more stable and provides shock absorption and good practicality.

The advantageous effects of the present invention are as follows:

When the mini foldable treadmill is in the unfolded state, the two handrails are locked to the upper end of the strut by the lock mechanism, the lower end of the spring pin is inserted into the hole of the fastening piece of the spring pin, so that the strut is locked to the running plate and the handrails are locked to the strut, when the mini foldable treadmill is in the folded state, the lock mechanism is opened, the handrails are rotated toward the strut to be folded, the swivel arm is driven by one end of the handrail to rotate around the second rotation axis, the transmission part is pulled upward by one of the connectors, the spring pin is pulled upward by the transmission component, the lower end of the spring pin is disconnected from the hole of the fastening piece of the spring pin, thereby the handrail is folded to the strut and the strut is folded to the running plate, compared with the treadmill in the prior art, the treadmill of this application has fewer parts, simpler structure and smaller occupied space, Therefore, the treadmill with mini and foldable features can be designed, and the treadmill can be folded and unfolded only by unlocking the handrail and the strut with hands, and then the user can complete all the operations by operating the handrail, and the user doesn't need to bend down to unlock the strut and the running plate, so the operation is simple and convenient for the user, and the practicality of the treadmill is good.

BRIEF DESCRIPTION OF THE DRAWINGS

To illustrate the technical solutions according to the embodiments of the present disclosure or in the prior art more clearly, the accompanying drawings for describing the embodiments or the prior art are introduced briefly in the following. Apparently, the accompanying drawings in the following description are only some embodiments of the present disclosure, and persons of ordinary skill in the art can derive other drawings from the accompanying drawings without creative efforts.

Figure 1:
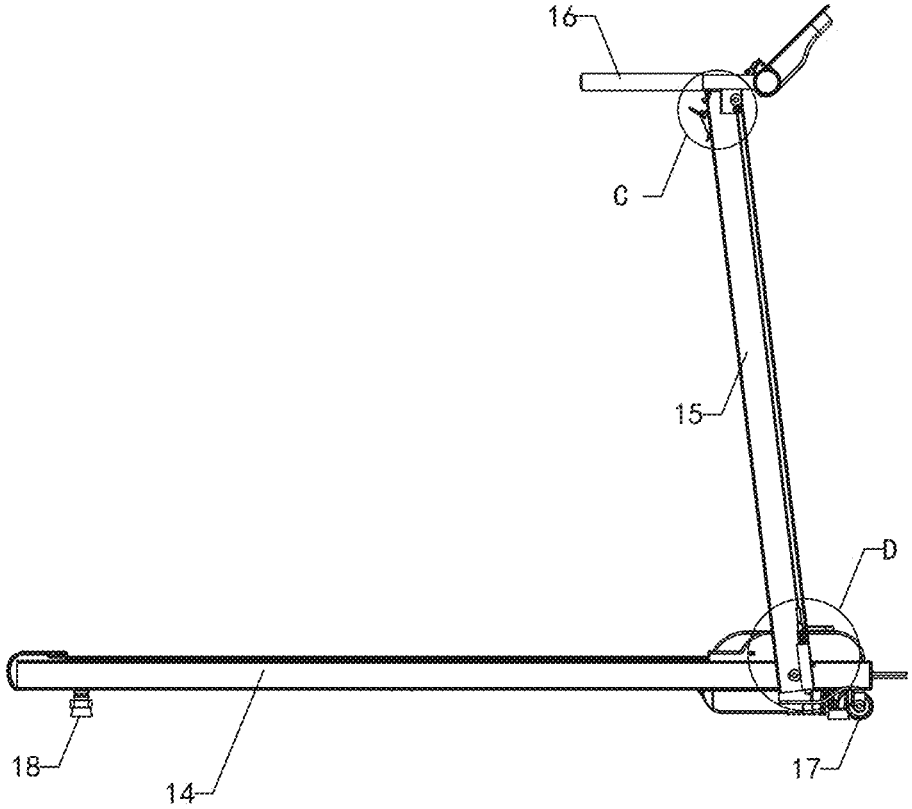
FIG. 1 is a schematic diagram of a structure of a mini foldable treadmill according to an embodiment of this application.
Figure 2:
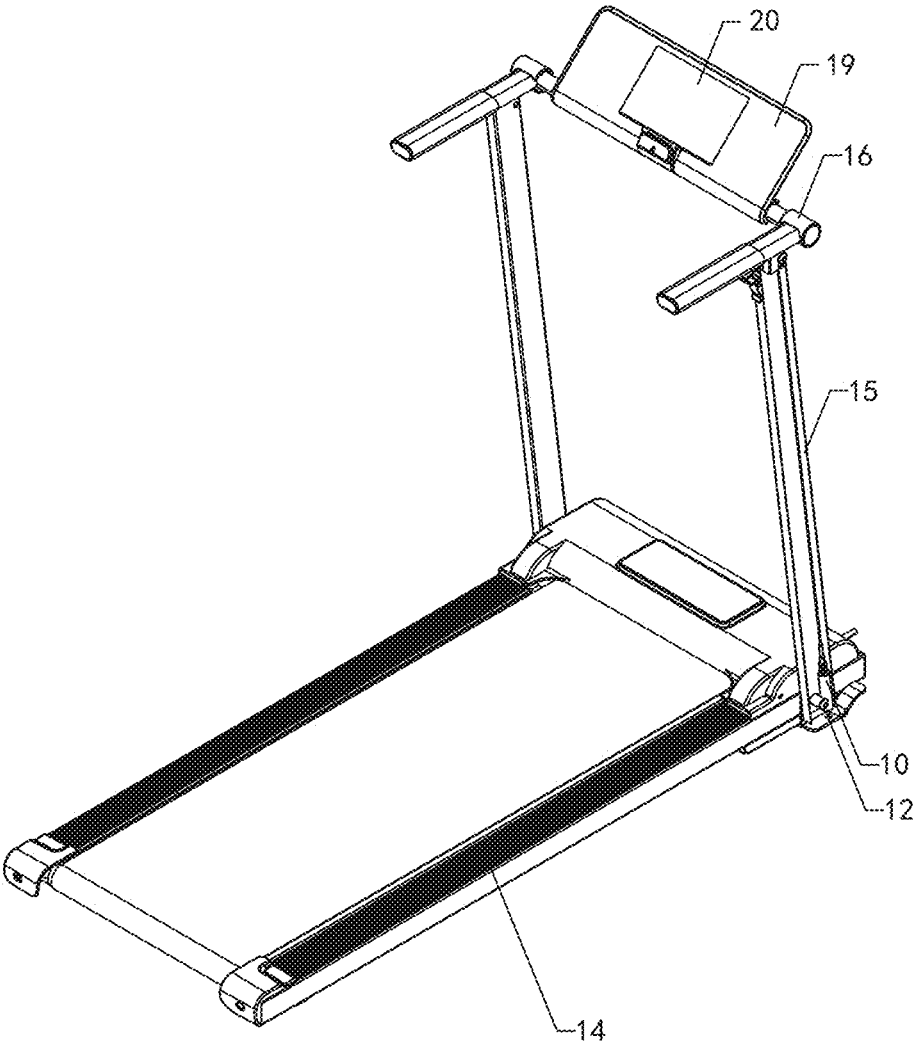
FIG. 2 is a perspective view of a structure of a mini foldable treadmill according to an embodiment of this application.

1. Second rotation axis; 2. Connector; 3. Wire rope; 4. Swivel arm; 5. Lock; 6. Handle; 7. Hook piece; 8. Spring pin; 9. Protective case; 10. Spring; 11. fastening piece; 12. hole; 13. first rotation axis; 14. running plate; 15. strut; 16. handrail; 17. roller; 18. pad.

DETAILED DESCRIPTION OF THE EMBODIMENTS

The present disclosure will be further described in detail below with reference to the drawings. A preferred embodiment is described in the drawings. However, the present disclosure can be implemented in many different forms and is not limited to the embodiments described herein. Rather, these embodiments are provided to provide a thorough understanding of the present disclosure. The specific embodiments are only explanations of the present disclosure, and the embodiments are not intended to limit the present disclosure. Rather, various modifications may be made in the details within the scope and range of equivalents of the claims and without departing from the present disclosure.

The present disclosure will be described in more details below with reference to the accompanying drawings and in conjunction with embodiments. The examples are provided for better illustration of the present disclosure and should not limit the scope of the present disclosure. In practice, technicians skilled in the art might make small modifications and/or variations of the present disclosure without departing from the scope or spirit of the present disclosure. For example, features described in part of one embodiment may be used in another to create a new embodiment. It is therefore desirable that the present disclosure encompass such modifications and/or variations falling within the scope of the appended claims and their equivalents.

In the description of the present disclosure, terms like "longitudinal", "transverse", "up", "down", "front", "back", "left", "right", "vertical", "horizontal", "top", "bottom" denote orientation or positional relationships based on those shown in the drawings and are intended for ease of description only, which in no way entails that the present disclosure must be constructed and operated in a particular orientation and therefore cannot be construed as limiting to the present disclosure. Terms like "joint", "attach" and "set" used in the present disclosure should be understood in a broad sense, for example, may indicate a direct connection or indirect connection through intermediate components; and it may be a wired electrical connection, a radio connection, or a wireless communication signal connection. The exact meanings of the above terms may slightly differ and should be derived from the actual situation by technicians skilled in the art accordingly.

A number of examples of the present disclosure are shown in the accompanying drawings, wherein the numeric and alphabetic markers used in the detailed description refer to features in the drawings. Reference signs in the drawings and descriptions may refer to similar parts of the present disclosure. As used herein, terms like "first", "second" and "third" are used interchangeably to distinguish one member from another and are not intended to denote the location or importance of individual members.

Embodiment 1: As shown in FIGS. 1 to 8, embodiments of the present application disclose a mini foldable treadmill comprising a running plate 14, at least one strut 15 and a frame, a handrail 16 and a console are disposed on the frame, a lower end of the strut 15 is rotatably connected to one end of the running plate 14; a lower end of the strut 15 is hinged to one end of the running plate 14 by a first rotation axis 13, swivel arms 4 of the same number as the struts 15 are disposed on the frame, a portion of the swivel arm 4 near the middle of the swivel arm 4 is hinged to the strut 15 by a second rotation axis 1, the connector 2 is disposed at the lower end of at least one of the swivel arms 4, the upper end of the transmission component is connected to the connector 2, the lower end of the transmission component is connected to the upper end of the spring pin 8, the spring pin 8 is slidably disposed at the lower end of the strut 15, the fastener of the spring pin 8 is disposed on the running plate 14, the pin hole fitting the spring pin 8 is disposed on the fastener of the spring pin 8, the spring pin 8 is selectively driven to extend so that the strut 15 is in an upright state, and it is driven to retract so that the strut 15 is not in an upright state. The fastener of the spring pin 8 is a fastening piece 11, which is disposed at one end of the running plate 14, and hole 12 of the fastening piece 11 of the spring pin 8 is disposed on the fastening piece 11 so that the lower end of the spring pin 8 is concentrically aligned with the hole 12 when the strut 15 is in an upright state; the fastening piece 11 of the spring pin 8 is configured with a spacing part, which is spaced from the lower end of the strut 15 to avoid the strut 15 from colliding with the fastening piece 11 when the strut 15 is rotated; the second rotation axis 1 and the first rotation axis 13 are both configured as a lead screw nut.

When the mini foldable treadmill is in the unfolded state, the handrail 16 is locked to the upper end of the strut 15 by the lock mechanism, and the lower end of the spring pin 8 is inserted into the hole 12 on the fastening piece 11 of the spring pin 8, so that the strut 15 is fixed to the running plate 14 and the handrail 16 is locked to the strut 15, and when the mini foldable treadmill is folded, The lock mechanism is opened, and the handrail 16 is rotated toward the strut 15 to make the handrail folded, and one end of the handrail 16 synchronously drives the swivel arm 4 to rotate around the corresponding second rotation axis 1, then the connector 2 pulls up the transmission component, and the transmission component pulls up the spring pin 8, so that the lower end of the spring pin 8 is disconnected from the hole 12 of the fastening piece 11 of the spring pin 8, thereby making the handrail 16 folded to the strut 15, and making the strut 15 folded to the running board 14, The components of the foldable mechanism are reduced, the structure of the foldable mechanism is simpler, the size of the foldable mechanism is smaller, and the treadmill can be mini and foldable at the same time, when the treadmill is folded and unfolded, the user only needs to unlock the handrail 16 and unlock the strut 15 by hand, and then rotate the handrail 16 to complete all the processes of folding, without the user bending down to unlock the strut 15 and the running board 14, so the user can easily and conveniently operate the treadmill, which has good practicality. With the spacing part of the fastening piece 11 of the spring pin 8, the fastening piece 11 of the spring pin 8 is disposed as close as possible to the lower end of the strut 15 to reduce the overall size of the treadmill, while the fastening piece 11 does not interfere with the rotation of the strut 15, furthermore, the lower end of the spring pin 8 is inserted more securely with the hole 12 of the fastening piece 11 of the spring pin 8, the second rotation axis 1 and the first rotation axis 13 are both configured as a lead screw nut, and the lead screw nut has good reliability and low cost.

Figure 3:
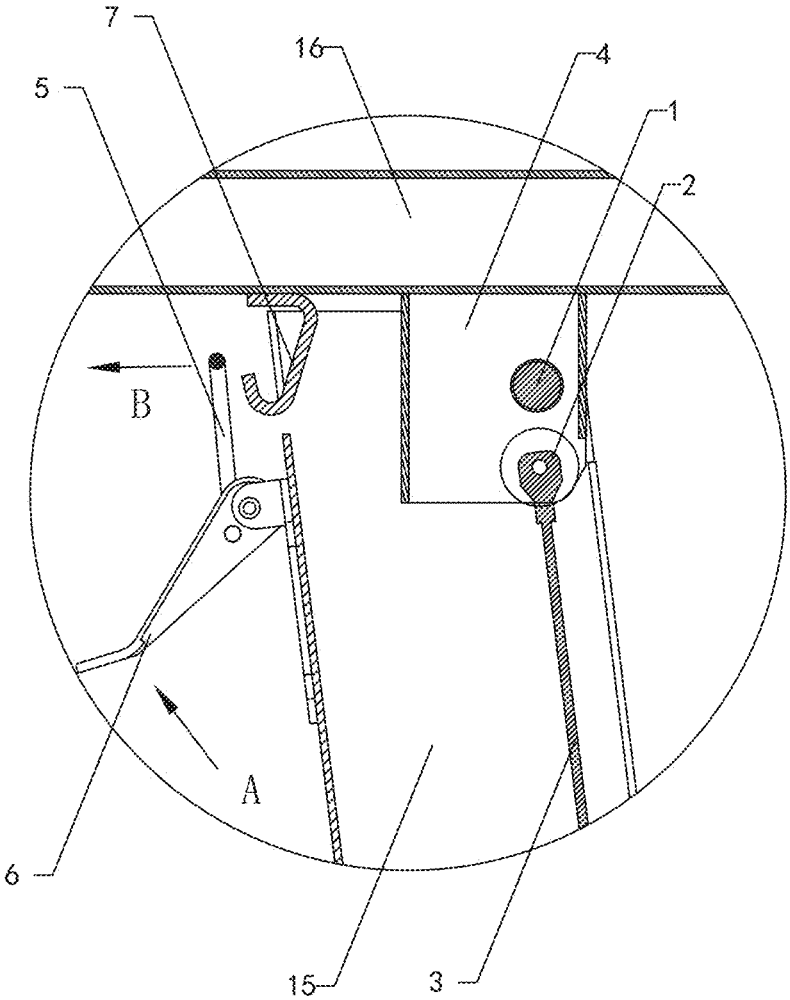
FIG. 3 is a partially enlarged view of a portion "C" indicated in FIG. 1.
Figure 4:
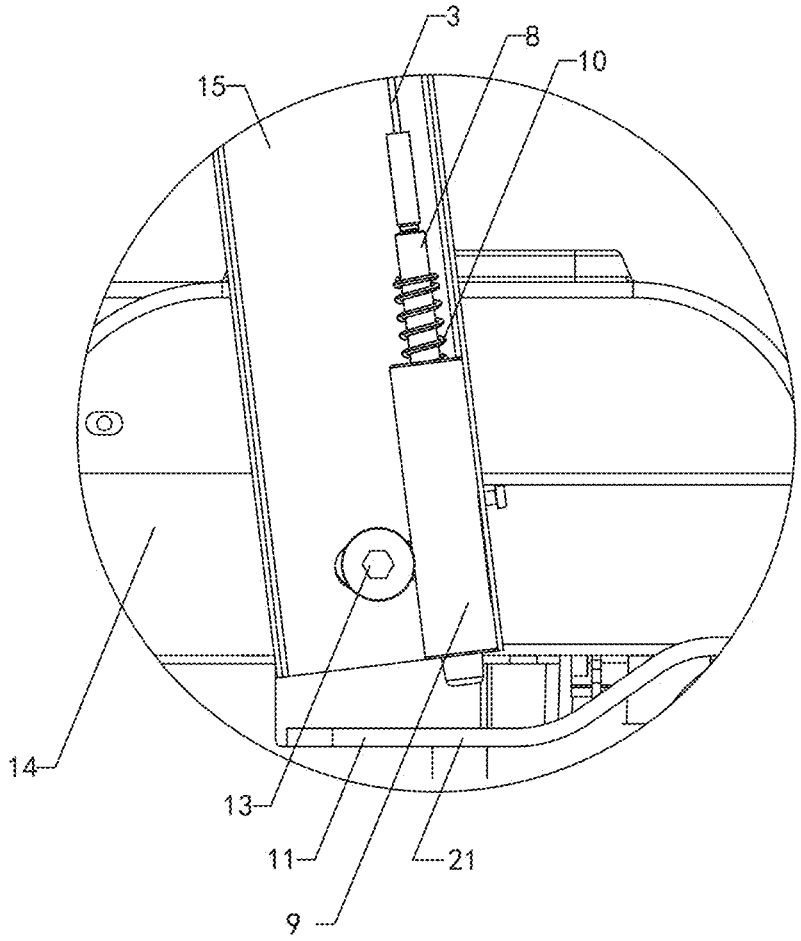
FIG. 4 is a partially enlarged view of a portion "D" indicated in FIG. 1.
Figure 5:
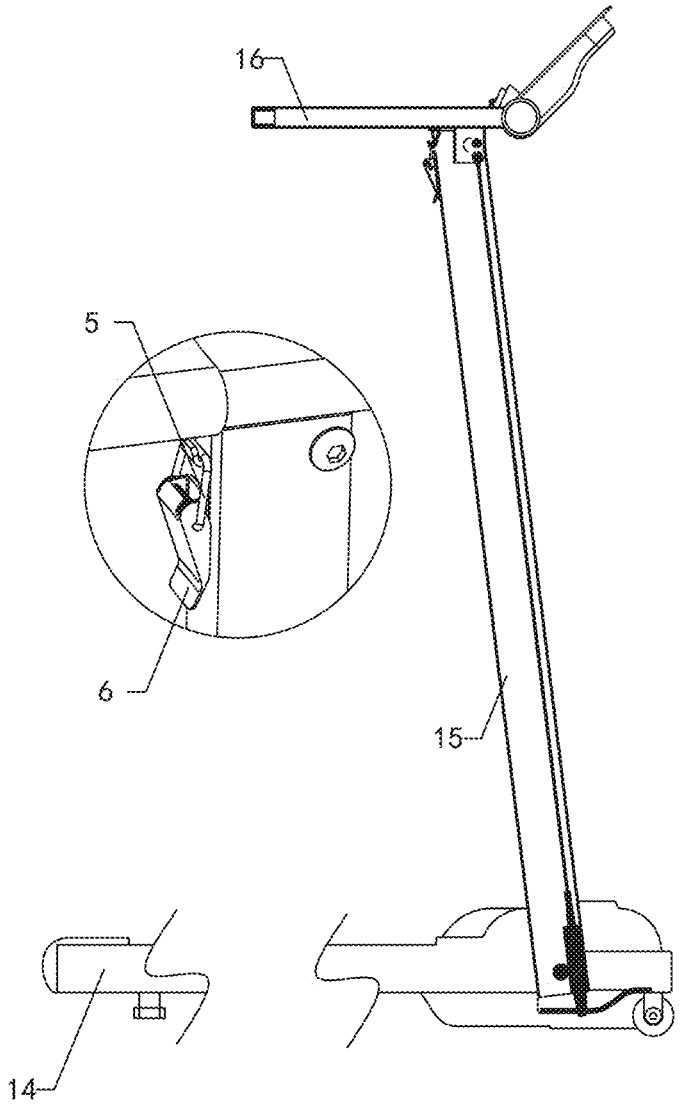
FIG. 5 is a schematic diagram of a structure of a mini foldable treadmill in an unfolded state according to an embodiment of this application.

Embodiment 2: As shown in FIGS. 3 and 4, embodiments of the present application disclose a mini-foldable treadmill comprising a running plate 14, at least one strut 15 and a frame on which handrails 16 and a console are disposed, the lower end of the strut 15 is rotatably connected to one end of the running plate 14; the lower end of the strut 15 is hinged to one end of the running plate 14 by a first rotation axis 13, swivel arms 4 of the same number as the struts 15 are disposed on the frame, the portion of the swivel arm 4 near the middle of the swivel arm 4 is hinged to the struts 15 by a second rotation axis 1, and the connector 2 is disposed at the lower end of at least one of the swivel arms 4, the upper end of the transmission component is connected to the connector 2, the lower end of the transmission component is connected to the upper end of the spring pin 8, which is slidably disposed at the lower end of the strut 15, the fastener of the spring pin 8 is disposed on the running plate 14, the pin hole fitting the spring pin 8 is disposed on the fastener of the spring pin 8, and the spring pin 8 is optionally actuated to extend to keep the strut 15 in an upright state, the spring pin 8 is optionally driven to retract so that the strut 15 is not in an upright state. The treadmill also comprises a protective case 9 and a spring 10, the protective case 9 is disposed at the lower end of the strut 15, the spring pin 8 is slidably inserted into the protective case 9, the periphery of the spring pin 8 is covered by a spring 10, one end of the spring 10 is connected to the spring pin 8 and the other end of the spring 10 is connected to the protective case 9, the spring pin 8 is moved towards the lower end of the strut 15 by the pushing force of the spring 10, the transmission component is configured as a wire rope 3, the strut 15 is configured as a square tube, and the strut 15 is configured with an opening at both the upper end and the lower end thereof, the swivel arm 4, the transmission component and the spring pin 8 are all located inside the square tube; the lock mechanism includes a lock 5, a handle 6 and a hook piece 7, and the upper end of the handle 6 is hinged to the side wall of the strut 15 by a axis, The lower end of the lock 5 is rotatably connected to a portion of the handle 6 near the middle of the handle 6, and the upper end of the lock 5 hangs on a hook at the lower end of the hook piece 7, which is disposed on the lower sidewall of the handrail 16.

When the two handrails 16 and the two struts 15 are locked, the lower end of handle 6 is pulled upward so that lock 5 is pulled upward and so that the upper end of lock 5 is hung on the hook of the lower end of the hook piece 7, which makes the lock 5 locked. The lower end of handle 6 is pulled downward to make lock 5 pulled downward as well as the hook piece 7 is pulled downward by lock 5, so that the upper end of the handrail 16 and strut 15 are locked, and connector 2 is driven by the swivel arm 4 to rotate downward and pull the wire rope 3 to move downward, thereby making the spring 10 push against the spring pin 8, and the spring pin 8 is moved toward the lower end of the strut 15 by the force of the spring 10, so that the spring pin 8 is guided downward by the protective case 9, thus making the spring pin 8 be automatically inserted into the hole 12 of the fastening piece 11 of the spring pin 8, as a result of which the strut 15 is automatically mounted and locked to the running plate 14. The wire rope 3 cooperates with the protective case 9 so that the swivel arm 4 and the spring pin 8 are reliably linked, and the folding parts are all contained inside the strut 15 for a more attractive and simple appearance.

Embodiment 3: As in FIG. 1, an embodiment of the present application discloses a mini foldable treadmill comprising a running plate 14, at least one strut 15 and a frame, a handrail 16 and a console are disposed on the frame, a lower end of the strut 15 is rotatably connected to one end of the running plate 14; a lower end of the strut 15 is hinged to one end of the running plate 14 by a first rotation axis 13, swivel arm 4 of the same number as the strut 15 is disposed on the frame, A portion of the swivel arm 4 near the middle of the swivel arm 4 is hinged to the strut 15 by a second rotation axis 1, a connector 2 is disposed at the lower end of at least one of the swivel arms 4, which is connected to the upper end of the transmission component, the lower end of the transmission component is connected to the upper end of the spring pin 8, the spring pin 8 is slidably disposed at the lower end of the strut 15, a fastener of the spring pin 8 is disposed on the running plate 14, a pin hole fitting the spring pin 8 is disposed on the fastener of the spring pin 8, the spring pin 8 is selectively driven to extend to keep the strut 15 in an upright state, and the spring pin 8 is driven to retract to make the strut 15 not in an upright state; the treadmill further comprises two rollers 17, the two rollers 17 being rotatably connected to the bottom of the running plate 14; the treadmill further comprises at least four pads 18, the pads 18 are disposed at the four corners of the bottom of the running plate 14.

Figure 6:
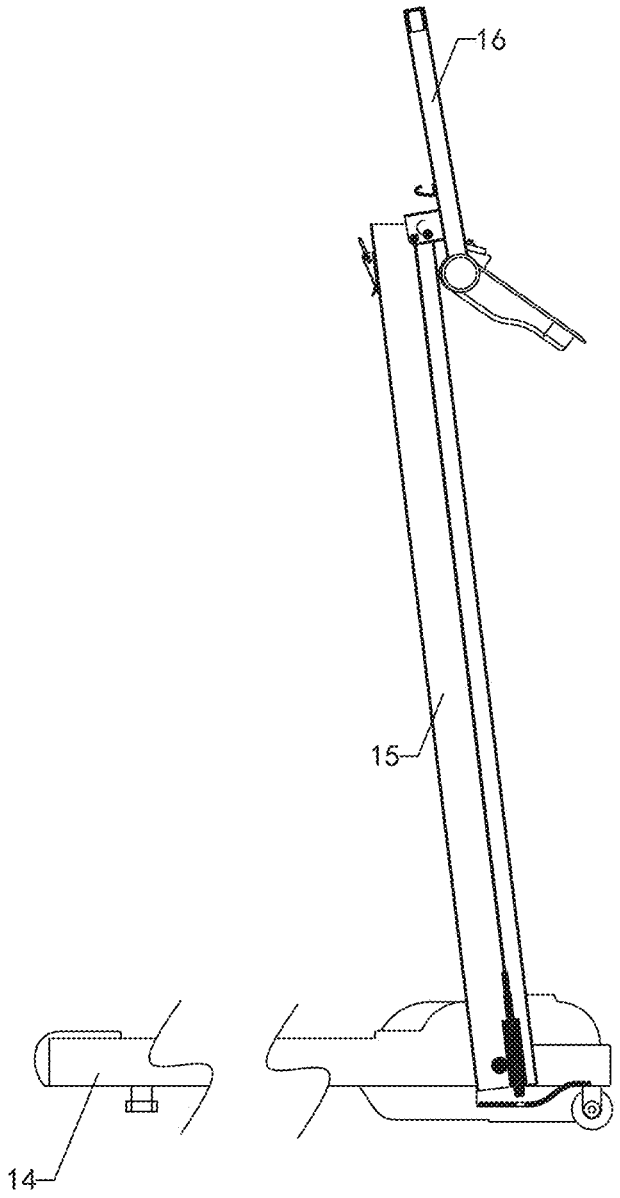
FIG. 6 is a schematic diagram of a structure of a handrail in a folded state according to an embodiment of this application.

As shown in FIGS. 1 to 8, a mini foldable treadmill disclosed in embodiments of the present application, during the operation of the treadmill, the treadmill is folded in the following steps:

(a) In the first step, a user first pulls the lower end of handle 6 by hand along the direction of arrow A as shown in FIG. 3 so that lock 5 is disconnected from the hook piece 7 along the direction of the arrow B as shown in FIG. 3, whereby the handrail 16 can rotate around the second rotation axis 1 so that the handrail 16 is folded to make the treadmill into the state as shown in FIG. 6.

Figure 7:
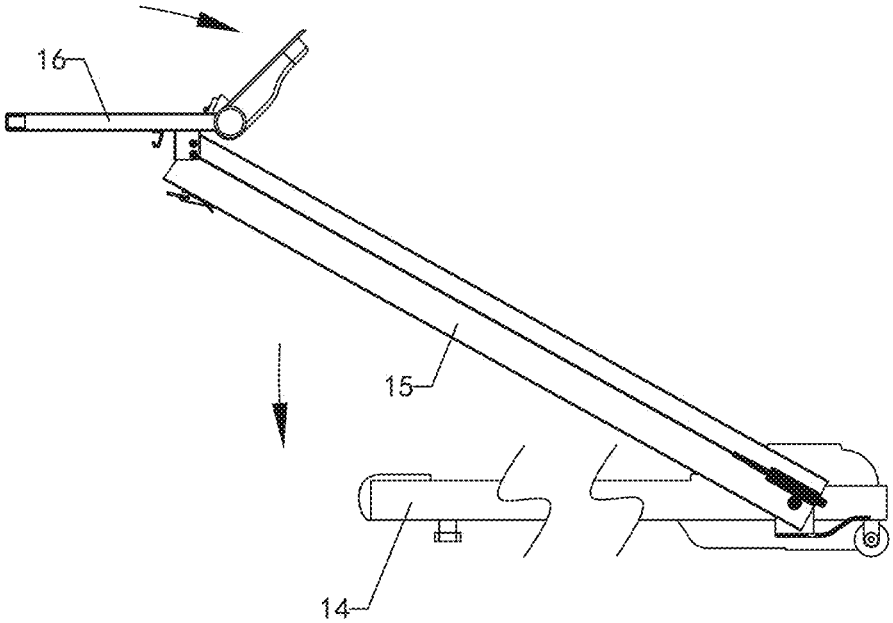
FIG. 7 is a schematic diagram of a structure of a strut in a folded state according to an embodiment of this application.

(b) In the second step, when the swivel arm 4 is rotated in a counterclockwise direction around the second rotation axis 1, the wire rope 3 enables the spring pin 8 to be pulled out of hole 12 of the fastening piece 11 of the spring pin 8, whereby the strut 15 can be rotated in a counterclockwise direction around the first rotation axis 13 to be lowered, as in the state of FIG. 7.

Figure 8:
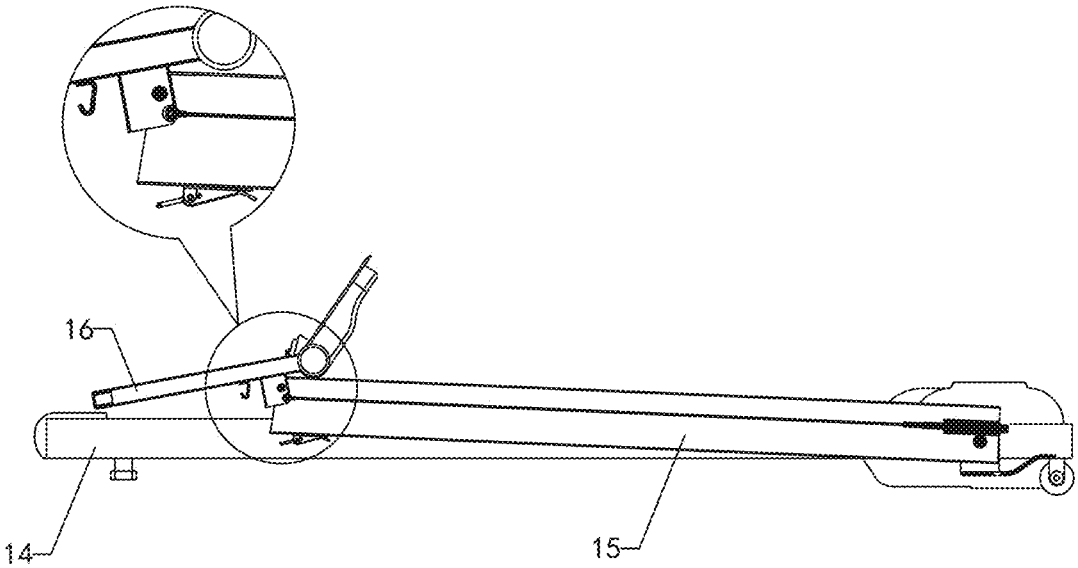
FIG. 8 is a schematic diagram of a structure of a mini foldable treadmill in a full folded state according to an embodiment of this application.

(c) Two struts 15 are folded on the running plate 14 to turn the treadmill into the state as shown in FIG. 8.

The main functions of a mini foldable treadmill disclosed in this application embodiment are as follows:

1. To make the treadmill structure simple and to make the size of the treadmill smaller so that a mini and foldable treadmill can be designed.

2. When the treadmill is folded and unfolded, the user doesn't need to bend down to make the two struts 15 and the running plate 14 unlocked, which is simple and convenient for the user to operate the treadmill;

3, A lot of standard parts are used in the treadmill to reduce the cost of the treadmill.

The embodiments described above are merely examples of the present disclosure, and should not be used to limit the scope of the present disclosure, which may have various modifications and variations made by specialists in the field. Any modification, equivalent replacement or improvement made within the spirits and principles of the present disclosure shall be included in the scope of protection of the present disclosure.

What is claimed is:

1. A mini foldable treadmill comprising:

a frame including a running plate;

at least one strut, rotatably connected to one end of said running plate, said at least one strut having a lower end and an upper end, said lower end being hinged to said one end of said running plate at a first rotation axis;

a handrail supporting a console, arranged on said upper end of said at least one strut;

at least one swivel arm mounted at an upper end on said at least one handrail, a part of said at least one swivel arm near a middle of said at least one swivel arm being hinged to said at least one strut at a second rotation axis, a lower end of said at least one swivel arm being provided with a connector;

a transmission component having an upper end connected to said connector and a lower end connected to an upper end of a spring pin, said spring pin slidably connected to said lower end of said at least one strut;

a fastener connected to said running plate, said fastener comprising a pin hole to fit said spring pin, said spring pin selectively actuatable to extend into said pin hole and to retract from said pin hole; and at least one lock mechanism comprising:

a lock;

a handle; and a hook piece, wherein: an upper end of said handle is hinged to an outer side wall of said at least one strut at said upper end of said at least one strut, a lower end of said lock is rotatably connected to a portion of said handle, and an upper end of said hook piece is disposed on a lower side wall of said handrail, and wherein an upper end of said lock detachably engages the hook piece to lock and unlock said at least one strut with respect to the running plate, wherein said at least one strut is rotatable between i) an upright state in which said spring pin is selectively actuated and extended into said pin hole and the upper end of said lock is hung on a hook at a lower end of said hook piece to lock said at least one strut in said upright state, and ii) a folded state in which the upper end of said lock is detached from the hook at the lower end of said hook piece to unlock said at least one strut from said upright state, said spring pin is selectively actuated and retracted from said pin hole and said at least one strut is rotated towards the running plate and into the folded state.

2. The mini foldable treadmill according to claim 1, wherein said fastener is a fastening piece, said fastening piece is connected to said one end of said running plate and said pin hole is disposed in said fastening piece such that a lower end of said spring pin is concentrically aligned with said pin hole when said at least one strut is maintained in said upright state.

3. The mini foldable treadmill according to claim 2, wherein said fastening piece comprises a spacing part, said spacing part and the lower end of said at least one strut are spaced apart to avoid the collision between said at least one strut and said fastening piece when said at least one strut is rotated.

4. The mini foldable treadmill according to claim 1, further comprising a protective case and a spring, wherein: said protective case is configured at the lower end of said at least one strut, said spring pin is slidably inserted in said protective case, said spring is disposed around a periphery of said spring pin, one end of said spring is connected to said spring pin and another end of said spring is connected to said protective case, and said spring pin is moved towards the lower end of said at least one strut by the thrust of said spring.

5. The mini foldable treadmill according to claim 1, wherein said transmission component is a wire rope.

6. The mini foldable treadmill according to claim 1, wherein: said at least one strut is configured as a square tube, said upper end and said lower end of said at least one strut is provided with openings, and said at least one swivel arm, said transmission component and said spring pin are located inside said square tube.

7. The mini foldable treadmill according to claim 1, wherein said first rotation axis and said second rotation axis are both configured as lead screw nuts.

8. The mini foldable treadmill according to claim 1, further comprising two rollers, wherein said two rollers are rotatably connected to a bottom of said running plate.

9. The mini foldable treadmill according to claim 1, further comprising at least four pads, wherein said at least four pads are disposed at corners of the bottom of said running plate.

* * * * *